United States Patent [19]

Mishima

[11] 4,220,067

[45] Sep. 2, 1980

[54] AUTOMATIC MUSICAL PERFORMANCE INSTRUMENT

[75] Inventor: Toshio Mishima, Shobu, Japan

[73] Assignee: Kabushiki Kaisha Kawai Gakki Seisakusho, Hamamatsu, Japan

[21] Appl. No.: 867,925

[22] Filed: Jan. 9, 1978

[30] Foreign Application Priority Data

Jan. 25, 1977 [JP] Japan ..... 52-6939

[51] Int. Cl.[3] ..... G10H 1/02

[52] U.S. Cl. ..... 84/1.03; 84/DIG. 22; 84/DIG. 12

[58] Field of Search ..... 84/1.01, 1.03, 1.24, 84/DIG. 22, DIG. 12

[56] References Cited

U.S. PATENT DOCUMENTS

| | | | |
|---|---|---|---|
| 3,842,184 | 10/1974 | Kniepkamp | 84/DIG. 22 |
| 3,929,051 | 12/1975 | Moore | 84/1.01 |
| 3,941,024 | 3/1976 | Brand | 84/1.01 |
| 3,954,038 | 5/1976 | Adams | 84/1.03 |
| 3,990,339 | 11/1976 | Robinson | 84/1.03 |
| 4,022,098 | 5/1977 | Deutsch | 84/1.03 |
| 4,054,078 | 10/1977 | Kondo | 84/1.24 |
| 4,100,831 | 7/1978 | Deutsch | 84/1.01 |
| 4,106,385 | 8/1978 | Roberts | 84/DIG. 22 |
| 4,162,644 | 7/1979 | Sakashita | 84/DIG. 22 |

*Primary Examiner*—J. V. Truhe
*Assistant Examiner*—William L. Feeney

[57] ABSTRACT

An automatic musical performance instrument which has a counter for counting a high-speed clock from a high-speed clock generator, a depressed key switch detector for generating a scanning pulse in synchronism with the high-speed clock to detect a depressed key switch, a circuit for storing in the form of a binary coded signal the output from the counter corresponding to the depressed key switch, a tone signal converter for converting the stored binary coded signal to a tone signal, and control means for sounding the tone signal in accordance with a rhythm pulse.

5 Claims, 7 Drawing Figures

AUTOMATIC MUSICAL PERFORMANCE INSTRUMENT

BACKGROUND OF THE INVENTION

1. Field of the Invention

This invention relates to an automatic musical performance instrument, and more particularly to an automatic arpeggio musical instrument.

2. Description of the Prior Art

Heretofore, there have been proposed methods for automatic arpeggio performance in Japanese Patent Disclosures Nos. 78316/76, 118412/74 and 101013/74 filed in the name of the assignee of the present application. However, these methods involve troublesome wiring operations because of large numbers of gate circuits and lines used, and also demand consideration to noise generation due to the long tone signal lines. Further, circuit structures embodying the above methods are not suitable for fabrication as integrated circuits, which results in the prevention of enhancement of reliability and miniaturization of the circuit structures.

SUMMARY OF THE INVENTION

An object of this invention is to provide an automatic musical performance instrument which employs a simple circuit structure but achieves arpeggio performance of good quality over a plurality of octaves by the depression of desired key switches.

The abovesaid object is achieved by providing an automatic musical performance instrument which is composed of a counter for counting a high-speed clock from a high-speed clock generator, a depressed key switch detector for generating a scanning pulse in synchronism with the high-speed clock to detect a depressed key switch, a circuit for storing in the form of a binary coded signal the output from the counter corresponding to the depressed key switch, a tone signal converter for the stored binary coded signal to a tone signal, and control means for sounding the tone signal in accordance with a rhythm pulse.

DESCRIPTION OF THE PREFERRED EMBODIMENTS

Figure 1:
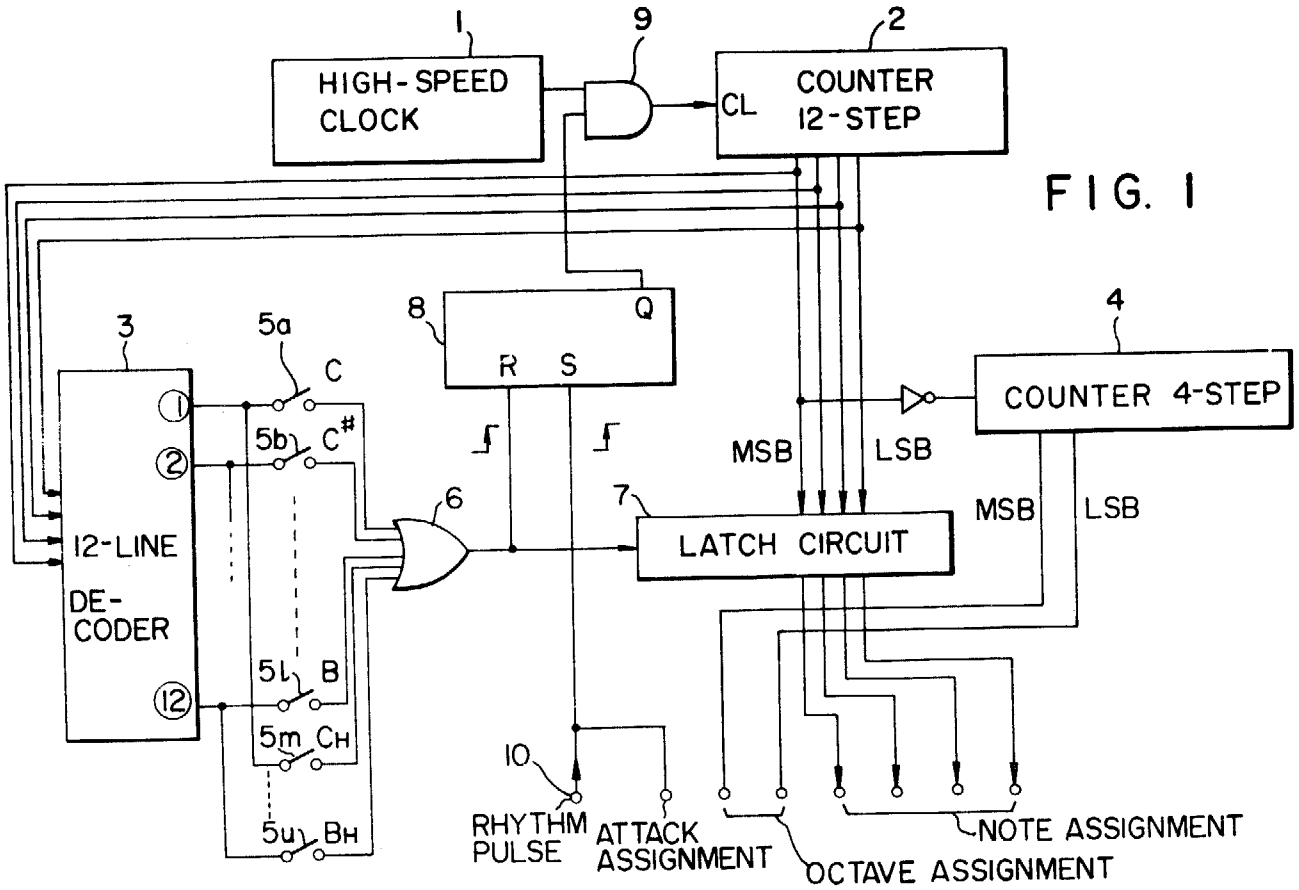
FIG. 1 is a block diagram showin the construction of an embodiment of this invention.

FIG. 1 is an explanatory diagram showing the construction of an embodiment of this invention. In FIG. 1, a high-speed clock generator 1 generates a clock of a very high frequency and clock pulses from the clock generator 1 are applied via an AND gate 9 to a 12-step counter 2. The count value of the 12-step counter 2 is provided to a 12-line decoder 3 to derive an output at one of its output terminals ① to "twelve" in accordance with the output numerical value. For example, when the output from the counter 2 is "0000", "0001", . . . or "1011", "1" if provided at the terminal ①, ② . . . or ⑫.

The outputs of the 12-line decoder 3 are connected in parallel to key switches 5*a* to 5*e* and 5*m* to 5*u* of an accompaniment manual keyboard in correspondence to notes of respective octaves. In the illustrated embodiment, the terminal ① is connected to the key switch 5*a* of the note C, the terminal ② to the key switch 5*b* of the note C#, . . . and the terminal ⑫ to the key switch 5*e* of the note B. The terminals ① to ⑫ are connected in parallel to key switches of a plurality of octaves. In FIG. 1, two octaves C to B and $C_H$ to $B_H$ are shown. The key switches 5*a* to 5*u* each have one contact connected to the output terminal of the 12-line decoder 3 and the other contact to an OR circuit 6. The output from the OR circuit 6 is provided to a latch circuit 7 and a reset terminal of a flip-flop (FF) 8.

When "1" is provided at the output terminal of the 12-line decoder 3 corresponding to the key switch being depressed, a latch signal is applied via the OR circuit 6 to the latch circuit 7 to store therein the output from the counter 2 and, at the same time, the flip-flop 8 is inverted to its set state to close the AND gate 9. As a result of this, no high-speed clock is applied to the 12-step counter 2 to stop its counting operation. Thus, a binary coded signal corresponding to the depressed key switch is derived as a note assignment signal from the output terminal of the latch circuit 7.

The counter 2 remains inoperative until a rhythm pulse is applied via a terminal 10 to the flop-flop 8 to set it.

Upon setting of the flip-flop 8 with the rhythm pulse, the counter 2 resumes its counting operation to hunt for the key switch depressed next. When the 12-step counter 2 has counted "12" with the high-speed clock and the rhythm pulse, the output value of a 4-step counter 4 increases by "1" to indicate a rise of one octave. That is, the 4-step counter 4 outputs numerical values "00" to "11" to achieve octave assignment.

Next, a description will be given of the case where the key switches of notes D, F# and A are depressed. At first, the high-speed clock is applied via the AND gate 9 to the 12-step counter 2, as described above. In this case, the flip-flop 8 is designed to be reset upon turning ON an arpeggio switch or AC switch. When supplied with the rhythm pulse, the flip-flop 8 is inverted to its set state to open the AND gate 9 to permit a supply of the high-speed clock to the 12-step counter 2.

When the output from the 12-step counter 2 becomes "0010", "1" is provided at the terminal ③ of the 12-line decoder 3. Since the terminal ③ is connected to the key switch D, the output "1" is provided via the OR circuit 6 to the latch circuit 7 to latch therein the output "0010" from the counter 2. The latched signal is outputted as a note assignment signal and, at the same time, it is applied to the flip-flop 8 to reset it, inhibiting the supply of the high-speed clock to the counter 2. This state is altered by setting of the flip-flop 8 with the rhythm pulse applied thereto from the input terminal 10.

Again, the counter 2 receives the high-speed clock to start and continue its counting operation until "0110" corresponding to the note F# is reached. When the count value "0110" is reached, an output "1" appears at the terminal ⑦ of the 12-line decoder 3 to reset the flip-flop 8 and to supply a latch signal to the latch circuit 7. Thus, the numerical value "0010" corresponding to the key switch D, latched until then, is erased and the numerical value "0110" corresponding to the key switch F# newly depressed is latched. Then, the numerical value "1001" corresponding to the key switch A is similarly latched with the next rhythm pulse.

In the above, the 4-step counter 4 outputs "00" and the abovesaid tone signals are converted as tone signals of a first octave by a tone signal converter for arpeggio performance of the notes D, F# and A.

Upon application of the next rhythm pulse, the 12-step counter 2 returns to "0000" from "1011" and keeps on counting. At this time, the output from the 4-step counter 4 changes from "00" to "01". The binary coded signals "0010", "0110" and "1001" are converted by the tone signal converter for arpeggio performance of D, F# and A of a second octave. After arpeggio performance of D, F# and A of third and fourth octaves, the operation is returned to the first octave and then the abovesaid operation is repetitously achieved.

Figures 3A, 3B, 3C:
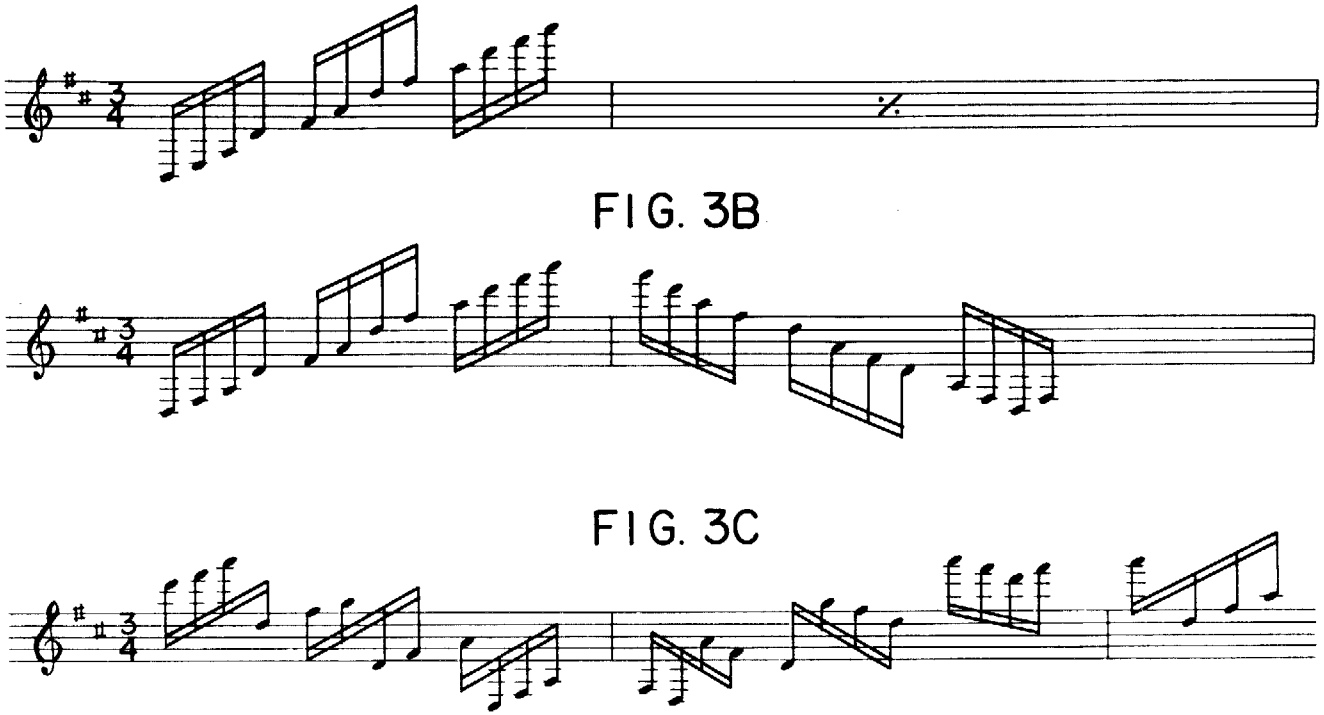
FIGS. 3A, 3B and 3C show musical signal patterns obtained with the embodiments of this invention, respectively.

FIG. 3A shows patterns of the arpeggio performance obtained with the above operation.

Figure 2:
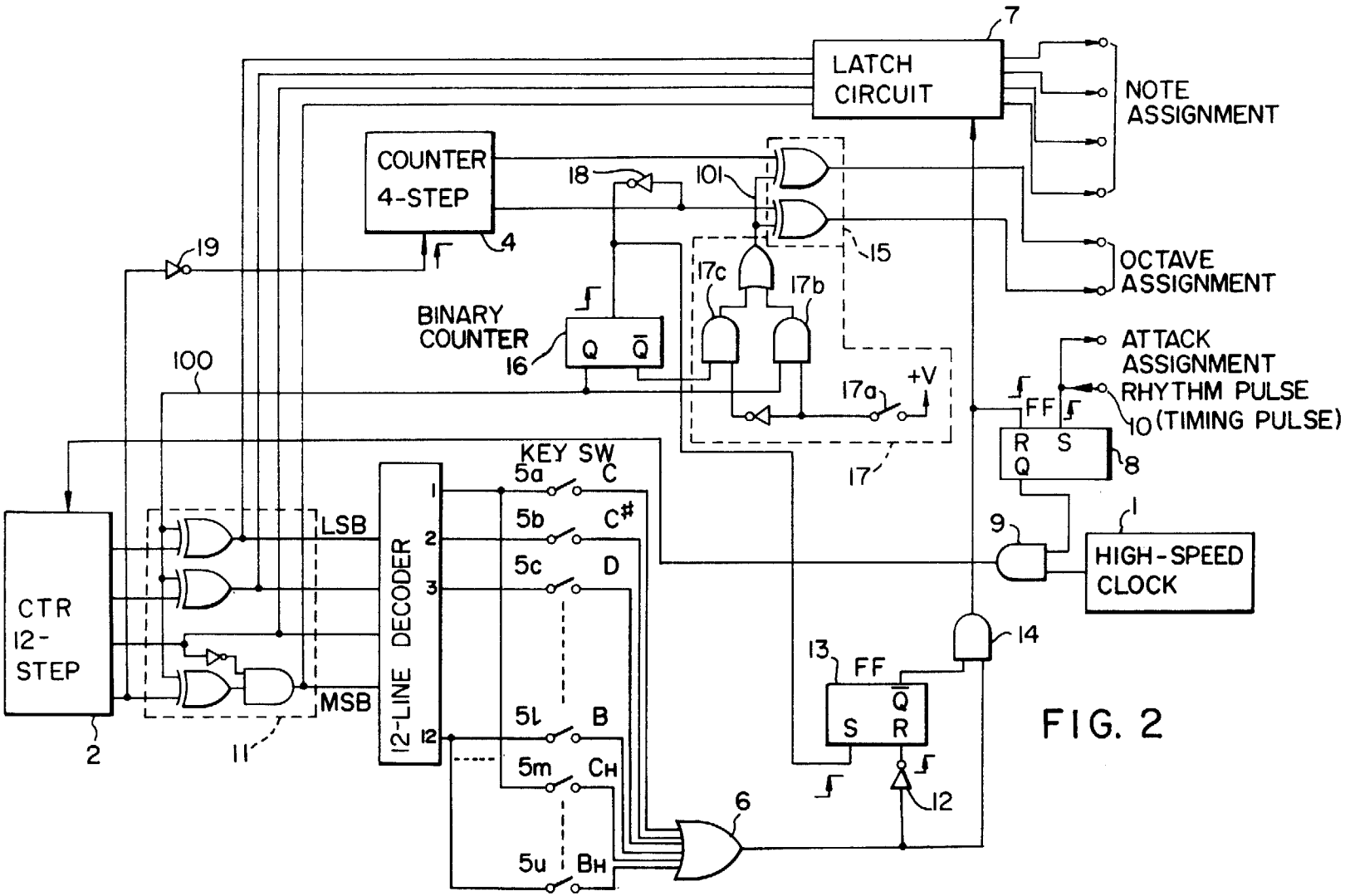
FIG. 2 is a block diagram illustrating the construction of another embodiment of this invention.

FIG. 2 is an explanatory diagram illustrating the construction of another embodiment of this invention, with which patterns shown in FIG. 3A or 3C are obtained. The embodiment of FIG. 2 is different from the FIG. 1 embodiment in that there are provided an inverter 18, a binary counter 16, a circuit composed of an inverter circuit 15 and a variation switching circuit 17 and another inverter circuit 11, whereby to switch the rise and fall of the arpeggio pattern. In addition, there is provided a circuit including an inverter 12, a flip-flop (FF) 13 and an AND gate 14, branched from the output of the OR circuit 6, thereby to prevent double sounding of a tone described later.

The inverter circuit 11 comprises exclusive OR circuits, an inverter and an AND circuit, and inverts the output from the 12-step counter 2, with the result that the counter 2 achieves backward counting. When a signal "0" is provided on a line 100, the output from the counter 2 is derived as it is from the inverter circuit 11. When a signal "1" is present on the line 100, as the output from the counter 2 changes in the order "0000"-"0001"-. . . "1011", the output from the inverter circuit 11 changes reversely in the order "1011"-"1010"-. . . "0000".

That is, backward counting takes place and where the signal "0" is on the line 100, the 12-line decoder 3 provides the output "1" at its terminals ① to ⑫ one after another, but where the signal "1" is on the line 100, the decoder derives the output at its terminals ⑫ to ① one after another.

The inverter circuit 15 is also to invert the output from the 4-step counter 4. That is, the output from the counter 4 changes in the order "00"-"01"-"10"-"11" but when a signal "1" is provided on a line 101, outputs "11", "10", "01" and "00" are sequentially derived at an octave assignment output terminal.

The variation switching circuit 17 is a gate circuit which is composed of an inverter, AND gates 17*b* and 17*c* and an OR circuit and placed under the control of a change-over switch 17*a*. Where the change-over switch 17*a* is in the OFF state, the AND gate 17*c* is opened to provide the output $\overline{Q}$ from the binary counter 16 on the line 101 of the inverter circuit 15.

Let it be assumed that the key switches D, F# and A are depressed, with the change-over switch 17*a* held in the ON state.

Such arrangements are made to reset the outputs Q and $\overline{Q}$ of the binary counter 16 when an arpeggio switch or AC switch (not shown) is turned ON. Accordingly, signals "0" are provided on the lines 100 and 101 and the output from the counter 4 is provided as the octave assignment signal.

In this manner, the notes D, F# and A of first, second, . . . octaves are repetitiously produced one after another in response to the rhythm pulse.

Upon application of the rhythm pulse after A of the fourth octave has thus been stored, the count value of the 4-step counter 4 returns to "00" from "11". This inverts the binary counter 16 via the inverter 18 and, at the same time, alters the flip-flop 13 to its set state. With the inversion of the binary counter 16, "1" is provided at its output Q and the output from the counter 2 is caused by the inverter circuit 11 to perform the aforesaid backward counting. As a result of this, the line decoder 3 provides the output "1" at its terminals from ⑫ to ① one after another and scanning effected so far in the order D-F#A is switched to the order A-F#-D.

Next, a description will be made of a double sounding preventive circuit which is comprised of the inverter 12, the flip-flop 13 and the AND gate 14 to prevent double sounding of one of the tones of arpeggio performance at the time of reversal of the order of tones to be produced.

When the binary counter 16 is inverted, the output "1" is provided from the OR circuit 6 via the key switch A corresponding to the terminal ⑩ of the line decoder 3 but since the flip-flop 13 is in the set state to retain the AND gate 14 in the closed state, the flip-flop 8 is not set. Accordingly, a supply of the high-speed clock to the 12-step counter 2 continues.

When the output at the terminal ⑩ of the line decoder 3 shifts to the next terminal ⑨, the flip-flop 13 is reset via the inverter 12 to open the AND gate 14 to start storing with the value of the next F#, that is, "0101". In this manner, the arpeggio performance of the notes D, F# and A in the order from the first to the fourth octave is switched from the notes F# and D of the fourth octave to those A, F# and D of the third octave without producing the last one A of the notes D, F# and A of the fourth octave twice. Thereafter, the notes A, F# and D of the first octave are followed by the notes F# and A of the first octave, those D, F# and A of the second octave, . . . in the same manner as described above. Such arpeggio performance is repetitiously achieved to obtain the pattern shown in FIG. 3B.

Next, a description will be given of the case where the variation change-over switch 17*a* is in the OFF state. Since the outputs Q and $\overline{Q}$ from the binary counter 16 are respectively "0" and "1" at first, "1" is provided on the line 101. Accordingly, the output from the 4-step counter 4 is inverted to provide "11", which is outputted as an octave assignment signal. The output from the 12-step counter 2 is applied as it is to the line decoder 3.

Thus, the notes D, F# and A of the fourth to first octaves are followed by the notes F# and D of the first octave and the notes A, F# and D of the second octave under the control of the double striking preventive circuit, obtaining the arpeggio pattern depicted in FIG. 3C.

Figure 4A:
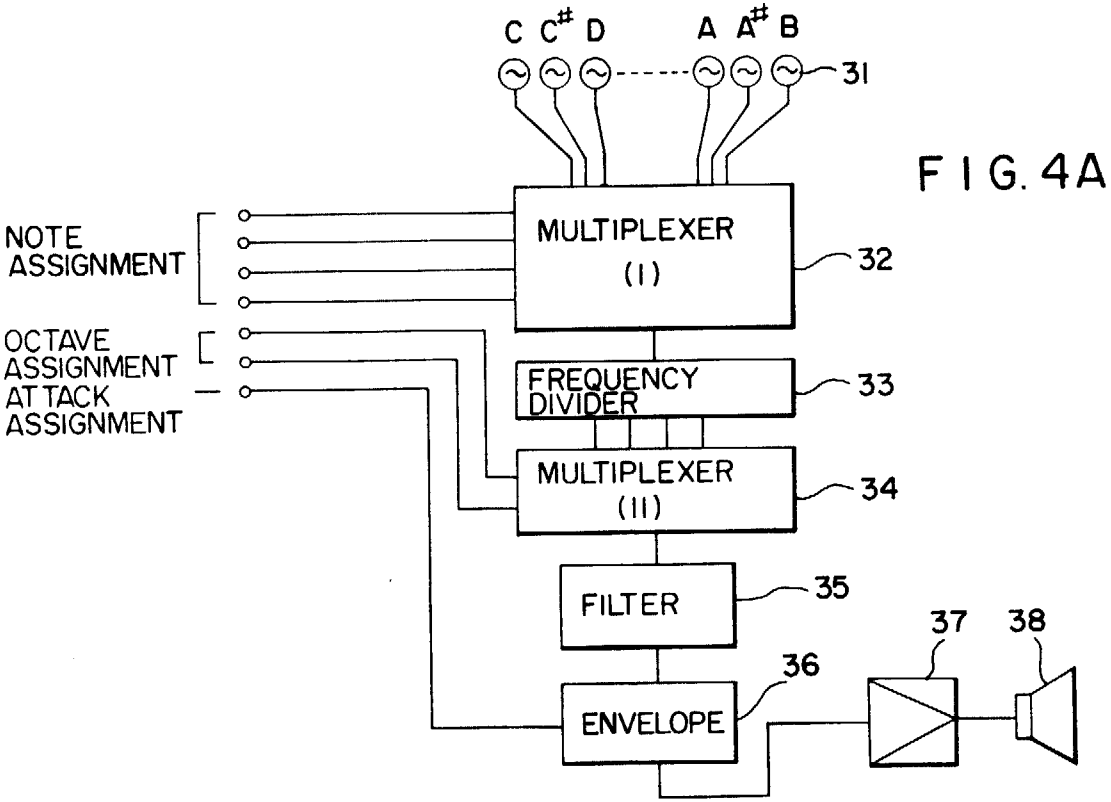
FIGS. 4A and 4B illustrate examples of a tone signal converter for use in this invention.
Figure 4B:
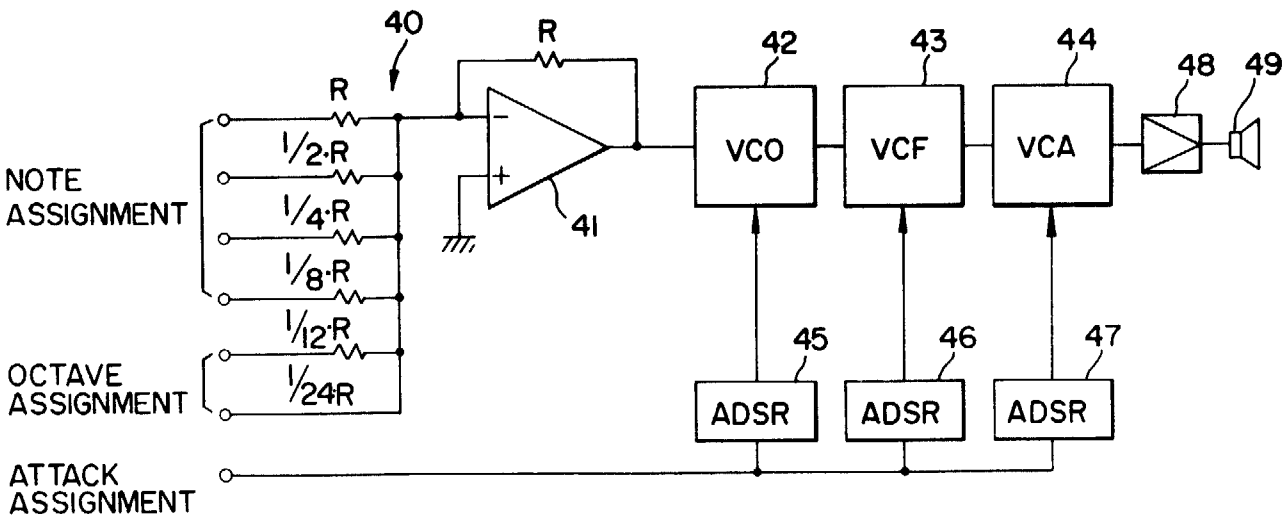

The note, octave and attack assignment signals thus obtained are applied to a tone signal converter of FIG. 4B to obtain tones.

In FIG. 4A, the note assignment signal in FIG. 1 or 2 is applied to a multiplexer (I) 32 to select sound sources C to B and the selected sound source is connected via a frequency divider 33 to a multiplexer (II) 34, in which a desired tone signal is obtained with the octave assignment signal. The tone signal is applied via a filter 35 to an envelope adder 36 for the attack assignment of an envelope, thereafter being applied via an amplifier 37 to a sound system 38.

FIG. 4B shows another example of the tone converter. In a D-A converter 40, the digital signal outputs for the note and octave assignment are connected in common via resistors R, R/2, R/4 and R/8 and via resistors R/12 and R/24, respectively. The output of the D-A converter 40 is connected to the negative side of an operational amplifier 41 having a feedback resistor R, the positive side of the operational amplifier 41 being grounded. A pitch determining voltage signal outputted from the operational amplifier 41 is applied to a voltage control circuit (VOC) 42 to generate a signal of the frequency corresponding to the pitch determining voltage signal from the operational amplifier 41. The signal thus obtained is applied to a sound system 49 via a voltage control filter (VCF) 43, a voltage control amplifier (VCA) 44 and an amplifier 48 in an ordinary manner. The voltage control circuit 42, the voltage control filter 43 and the voltage control amplifier 44 are controlled by the attack assignment signal via ADSR(Attack, Decay, Sustain and Release) circuits 45, 46 and 47, respectively.

The above has described examples of the tone signal converter but this invention is not limited specifically thereto. The tone signal converter for use in this invention may be of any circuit structure such as a circuit which achieves arpeggio performance at frequencies corresponding to the note and octave assignment signals and in which the frequency dividing ratio of a single frequency divider can be varied with the note information input.

A variety of arpeggio patterns can be obtained by changing the connections of the contro lines 100 and 101 for the exclusive OR circuits of the inverter circuits 11 and 15. It will be apparent to those skilled in the art to connect one of the output of the 4-step counter 4 to the line 100 or connect a random signal generator to each of the lines 100 and 101 for obtaining more varigated patterns.

As has been described above, according to this invention, a high-speed clock from a high-speed clock generator is counted by a counter, scanning pulses are produced in synchronism with the high-speed clock to detect a depressed key switch with a depressed key switch detector, the output from the counter corresponding to the depressed key switch is stored in the form of a binary coded signal in a memory circuit and the binary coded signal stored in the memory circuit is converted by a tone signal converter to a tone signal, which is sounded in accordance with a rhythm pulse. With such a construction, arpeggio performance for several octaves can be effected with a simple circuit structure and, in addition, a variety of arpeggio patterns can be obtained. Since binary coded signals are used for processing, the circuit structure is suitable for fabrication as an integrated circuit. Further, since the tone signal is produced in the form of a binary signal, the numbers of gate circuits and lines needed are small. Moreover, the tone signal line need not be long, so that noise generation can be suppressed.

It will be apparent that many modifications and variations may be effected without departing from the scope of the novel concepts of this invention.

What is claimed is:

1. An automatic musical performance instrument which successively outputs notes corresponding to depressed keys in synchronism with rhythm pulses from a rhythm generator to perform auto-arpeggio comprising:

a counter for counting a high-speed clock from a high-speed clock generator and producing a binary coded output count signal;

a depressed key detector for generating a scanning pulse in synchronism with the counter to detect a depressed key;

a key switch circuit for generating a depressed key signal with the scanning pulse from the depressed key detector;

control means for maintaining said counter operative in response to a rhythm pulse from a rhythm pulse generator and for maintaining said counter inoperative in response to the depressed key signal from the key switch circuit the rhythm pulse then causing a resumption of operation of the counter;

a latch circuit for storing a single binary coded signal from the counter representative of a single note in response to the depressed key signal from the key switch circuit; and a tone signal converter for converting the binary coded signal from the latch circuit to a tone signal which is produced at the appropriate time in accordance with the rhythm pulse, whereby upon each application of the rhythm pulse the binary coded signal of the next depressed key signal is stored in the latch circuit and converted into a corresponding tone signal.

2. An automatic musical performance instrument as in claim 1, wherein said counter is a twelve step note counter, and further comprising an additional octave counter responsive to the output of said note counter to produce an octave assignment signal, the octave assignment signal also being applied to said tone converter.

3. An automatic musical performance instrument as in claim 2, and further comprising inverter means for permitting both the rise and fall of the arpeggio pattern.

4. An automatic musical performance instrument as in claim 3, and further comprising circuit means for preventing the double sounding of a tone at the top or bottom of the arpeggio pattern.

5. An automatic musical performance instrument as in claim 3, wherein said inverter means is coupled to said note counter and said octave counter and reverses the count output of said counter, and switch means for selecting the type of arpeggio pattern desired.

* * * * *